US006334543B1

(12) United States Patent
Abbondandolo

(10) Patent No.: US 6,334,543 B1
(45) Date of Patent: Jan. 1, 2002

(54) COLLAPSIBLE CONTAINER

(76) Inventor: Robert Abbondandolo, 1921 SE. 1st Ter., Cape Coral, FL (US) 33990

( * ) Notice: Subject to any disclaimer, the term of this patent is extended or adjusted under 35 U.S.C. 154(b) by 0 days.

(21) Appl. No.: 09/626,257

(22) Filed: Jul. 26, 2000

Related U.S. Application Data

(60) Provisional application No. 60/145,992, filed on Jul. 29, 1999.

(51) Int. Cl.[7] ..... B65D 37/00

(52) U.S. Cl. ..... 220/666; 215/382; 215/900; 224/42.13

(58) Field of Search ..... 220/666; 215/382, 215/900; 224/314, 42.24, 42.13; 220/254, 601; 141/114

(56) References Cited

U.S. PATENT DOCUMENTS

| | | | | | |
|---|---|---|---|---|---|
| 3,083,877 | A | * | 4/1963 | Gash | 215/900 X |
| 4,873,100 | A | * | 10/1989 | Dirksing et al. | 215/382 X |
| 5,447,110 | A | * | 9/1995 | Brown | 220/666 X |
| 5,862,940 | A | * | 1/1999 | Chism et al. | 320/666 |
| 5,941,432 | A | * | 8/1999 | Spencer | 224/42.13 |
| 6,047,848 | A | * | 4/2000 | Davis | 220/666 |

* cited by examiner

*Primary Examiner*—Steven Pollard

(57) ABSTRACT

The instant invention is a foldable plastic container consisting of accordion type pleats, a top having a circular depression for filling/emptying the container, a folding handle fastened to the top, and a telescoping nozzle which may be nested and contained in the cover or expanded for pouring a liquid.

3 Claims, 3 Drawing Sheets

COLLAPSIBLE CONTAINER

RELATED INVENTION

The instant invention is a Continuation-In-Part of Provisional Application Ser. No. 60/145,992, Filed Jul. 29,1999.

BACKGROUND

1. Field of the Invention

The present invention relates generally to containers, and more specifically, to a plastic, foldable container that can be used in an automobile as an emergency can.

2. Prior Art

The use of a containers filled with gasoline carried in the trunk of a car is well known. Carrying a typical gas can uses much of the storage space in the trunk of the car. The same problem arises with the carrying of fuel to refuel an outboard motor boat. After the gas is poured, a large container is still taking up extra space.

SUMMARY OF THE INVENTION

The instant invention is a foldable container that can be used in an automobile as an emergency gas can or for any other liquid requiring ease of pouring and storing the container. The "can" of this invention will fold down to "inches" and may be stored in the trunk of a car and will not take up as much room as a conventional gas can. The container of the invention consists generally of accordion type pleats. The top is formed with a foldable handle and a depression containing the pouring nozzle. A cover, having a two piece telescoping nozzle is used with a plug to seal the container. The telescoping nozzle is retracted, inverted, and stored inside the cover when the cover is closed.

DETAILED DESCRIPTION OF A PREFERRED EMBODIMENT

Figure 1:
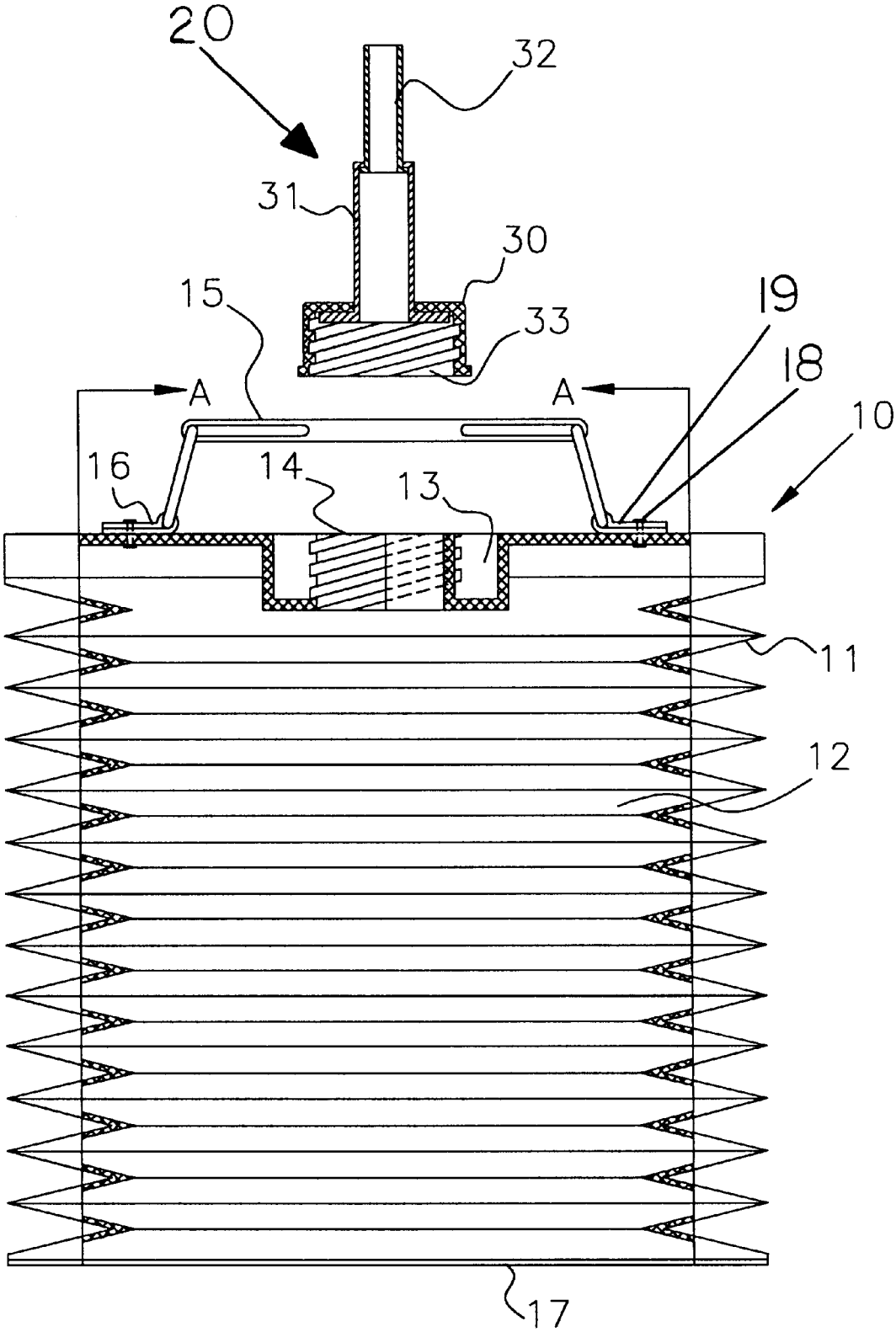
FIG. 1 is a side view, partly in section, along line A—A, of FIG. 2, of the container in accordance with the invention.
Figure 2:
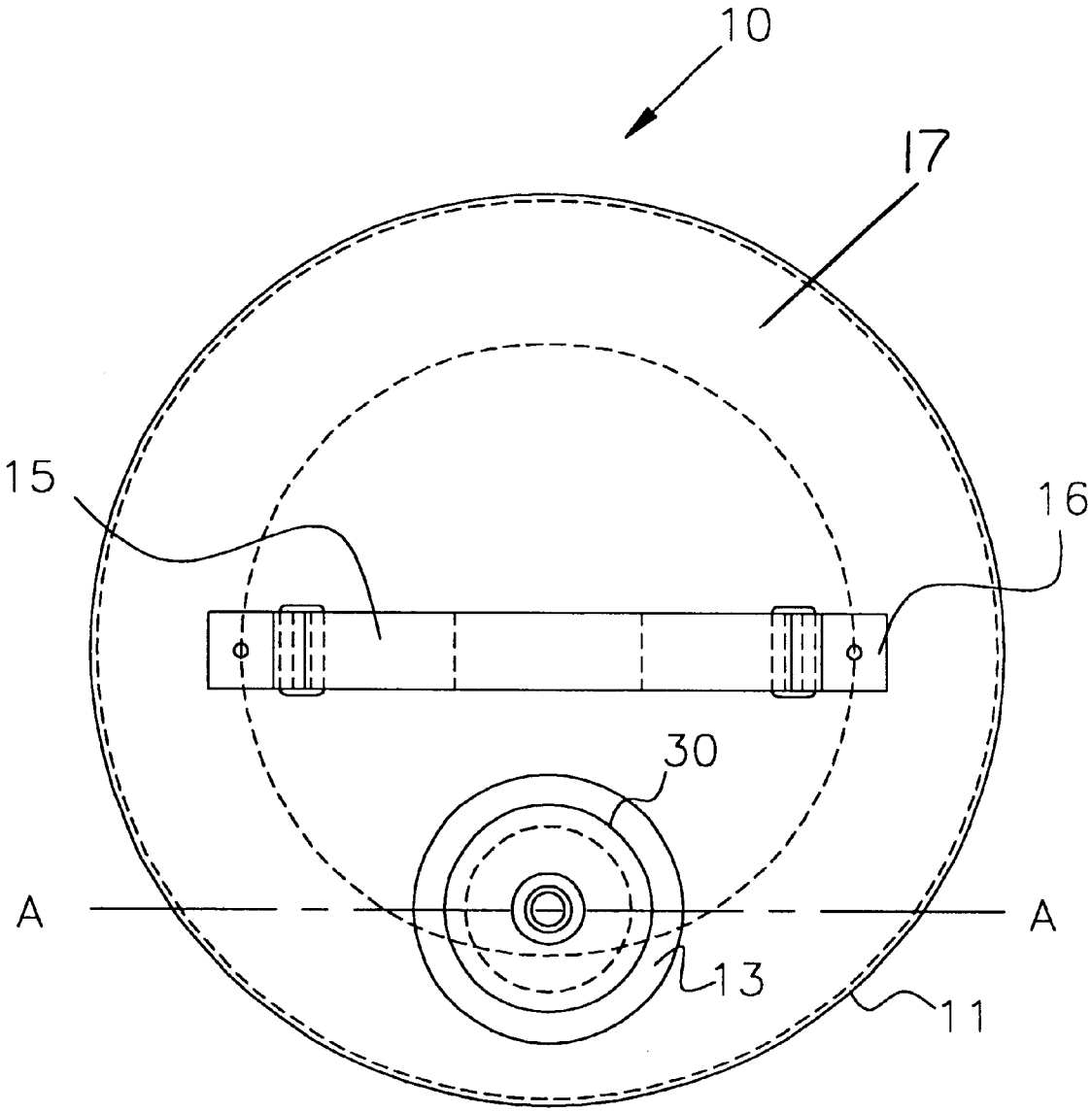
FIG. 2 is a top view of the container in accordance with the invention.

The container of the invention, shown in FIG. 1, is designated generally by the numeral 10 and consists generally of accordion type pleats 11 and 12 shown in an open position.

The top 17 is formed with a depression 13 having a threaded projection 14 formed therein for filling and emptying the container 10. Cover 30 is shown in FIG. 1 with telescoping nozzle 20 ready for pouring.

A folding handle 15 is pivoted in brackets 16 and 19 fastened to the top 17 with rivets 18. To unfold the container 10, the folding handle 15 is pulled while holding the bottom 17 and it will unfold.

Figure 3:
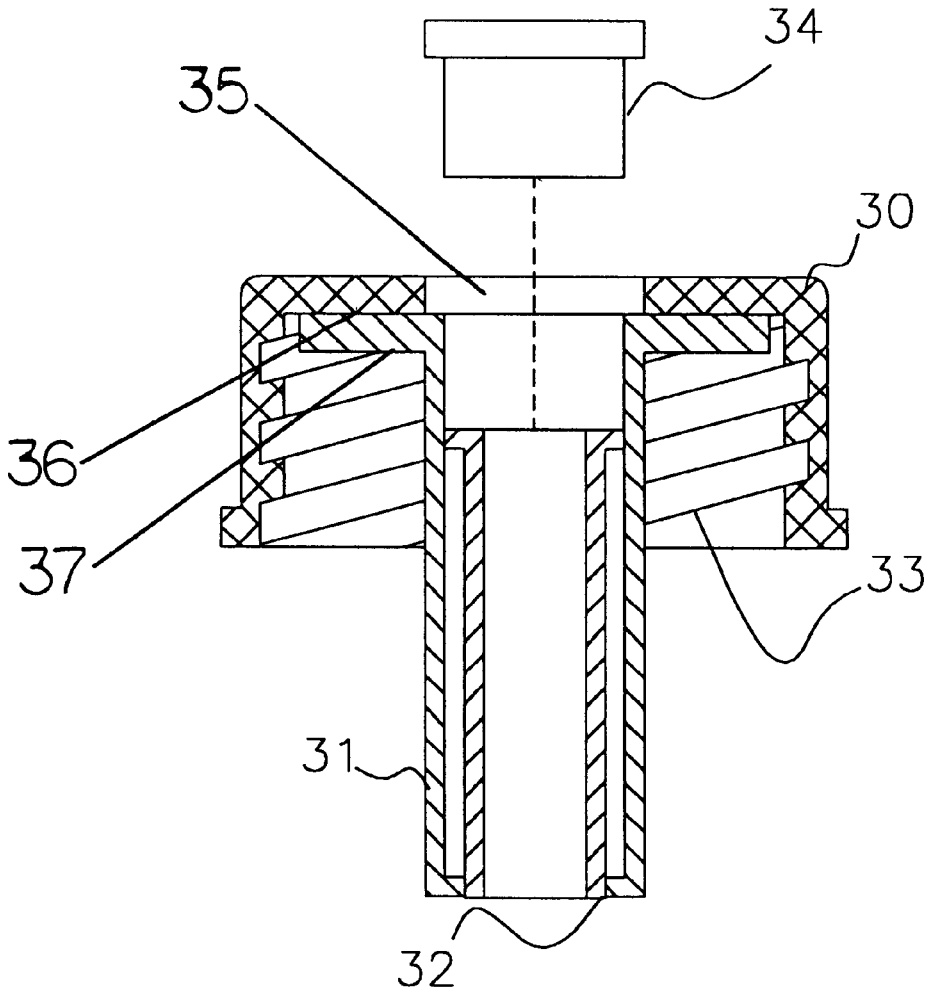
FIG. 3 is a side, sectional view of the container in accordance with the invention.

FIG. 3 is a side view of the telescoping nozzle 20 consisting of lower section 31, and upper section 32 nested in the cover 30. Lower section 31 is shown abutting the inside surface 36 to form a seal. The cover 30, having threads 33, is screwed onto threaded projection 14 and bottom surface 37 engages threaded opening 14 to seal the container 10. Stopper 34 is plugged into hole 35 in cover 30 for sealing the container 10.

Figure 4:
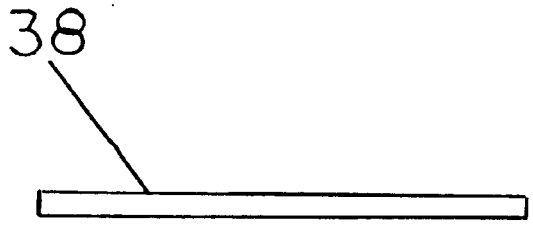
FIG. 4 is a side view of an alternative embodiment for a seal in accordance with the invention.

FIG. 4 shows a disk seal 38 which may be used in an alternative embodiment to seal the hole 35. In operation, the seal 38 is placed inside the cover 30 before the lower section 31 is inserted and is gripped between the inside surface 36 of cover 30 and lower section 31 thus blocking the hole 35 and sealing the container 10.

While the principles of the invention have been described above in connection with a specific embodiment of the application, it is to be understood that this description is made only by way of example and not as a limitation on the scope of the invention.

What is claimed is:

1. A foldable plastic container that can fit into confined spaces such as the trunk of a car, said container consisting of:

a top, a bottom and an outer wall having accordion type pleats extending from said top to said bottom, said accordion type pleats forming the outer surface of the container, said accordion type pleats being selectively expanded and contracted to expand/reduce the volume of the container, a circular depression formed in said top, said depression having a threaded projection formed therein for filling/emptying the container, a folding handle pivotally fastened to said top, an internally threaded cover having a hole formed therein, a nozzle having a lower section and an upper section, said lower and upper sections being assembled with said upper section inserted within said lower section, said nozzle being nested in said cover, and a seal for blocking said nozzle for sealing the container.

2. A foldable plastic container as described in claim 1 wherein said seal for blocking said nozzle consists of a plastic plug.

3. A foldable plastic container as described in claim 1 wherein said seal consists of a disk seal.

* * * * *